United States Patent [19]

Lange et al.

[11] Patent Number: 4,513,924

[45] Date of Patent: Apr. 30, 1985

[54] PROCESS AND APPARATUS FOR PRODUCING ROLLS OF WIRE NETTING

[76] Inventors: Gerhard Lange, Brahmsstrasse 16, D-7410 Reutlingen 1; Giovanni T. Angeli, Via Pietro de Crescenzo 32, I-48 018 Faenza (Ravenna), both of Fed. Rep. of Germany

[21] Appl. No.: 416,970

[22] Filed: Sep. 13, 1982

[30] Foreign Application Priority Data

Sep. 12, 1981 [DE] Fed. Rep. of Germany ..... 3136207

[51] Int. Cl.[3] ..... B65H 17/12; B65H 17/16; B65H 25/04; B65H 25/28

[52] U.S. Cl. ..... 242/67.2; 242/68.7; 242/DIG. 3; 242/57; 226/44

[58] Field of Search ..... 242/67.2, DIG. 3, 68.7, 242/57, 67.1 R, 75.1, 55, 55.1, 54 R; 53/118, 430; 100/87, 88; 226/44

[56] References Cited

U.S. PATENT DOCUMENTS

| | | | |
|---|---|---|---|
| 1,959,418 | 5/1934 | Fourness | 242/67.1 R X |
| 2,353,821 | 7/1944 | Fourness et al. | 53/118 X |
| 2,939,645 | 6/1960 | Rowlands et al. | 242/DIG. 3 X |
| 3,532,281 | 10/1970 | Verstraete | 242/55 |
| 3,991,538 | 11/1976 | Finn et al. | 242/DIG. 3 X |
| 4,063,693 | 12/1977 | Achelpohl et al. | 53/118 X |
| 4,114,530 | 9/1978 | Miller | 242/DIG. 3 X |
| 4,139,976 | 2/1979 | Herrig et al. | 53/118 X |
| 4,146,188 | 3/1979 | Hewinson et al. | 242/75.1 X |
| 4,389,025 | 6/1983 | Pilboue | 242/67.2 X |

FOREIGN PATENT DOCUMENTS 0031286 1/1981 European Pat. Off. .

*Primary Examiner*—Harvey C. Hornsby
*Assistant Examiner*—Scott J. Haugland
*Attorney, Agent, or Firm*—Wigman & Cohen

[57] ABSTRACT

In order that a roll which is at least as highly compacted as that according to EP No. 0 031 286 Al may be obtainable trouble-free and with less expenditure of material and labor in the production of reelless rolls by laying the netting in zigzag formation and rolling it up by means of inclined guide surfaces followed by winding portions which constitute a receiver of variable shape for the roll and are displaceable in their longitudinal direction, it is proposed that the winding operation should be carried out intermittently; the partially completed roll should be rolled over the adjoining netting which is laid in zigzag formation, and the roll, having been thereby enlarged, should be transported back to what was its starting point before this rolling movement, and these procedures should be repeated cyclically. For this purpose, a winding driving device is provided to shorten the winding portions for the purpose of rolling up the netting, several transport portions (88) also adjoining the guide surfaces (40) are provided for returning the roll to its starting position, and a transport driving device is provided for transporting the roll with simultaneous lengthening of the winding portions.

11 Claims, 7 Drawing Figures

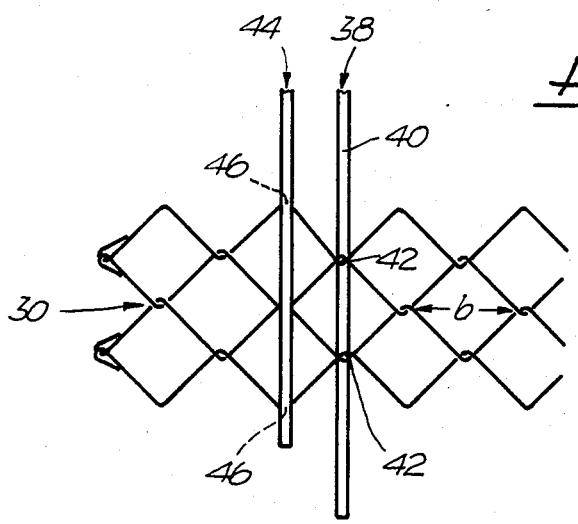
Fig. 6.
Fig. 7.
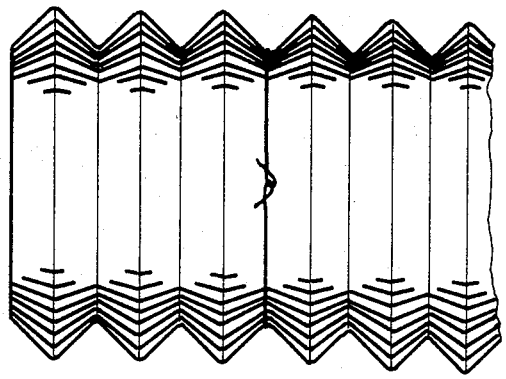

PROCESS AND APPARATUS FOR PRODUCING ROLLS OF WIRE NETTING

This invention relates to a process for producing reelless rolls of endless wire netting in the form of webs consisting of flat-pressed wire coils wound into each other, in which the flattened netting is shortened and thickened by being laid in zig-zag formation, the compressed netting is rolled up and the rear end of each section of netting which is to give rise to a roll is severed from the front end of the following section of netting before being rolled up. It also relates to an apparatus for carrying out this process, comprising several parallel guide surfaces inclined at the same angle to the horizontal, each for receiving a row of hooking and linking points of the netting; and further comprising several endless winding strands extending in parallel vertical planes along paths which cover each other at least in sections, each strand having a winding portion adjoining the guide surfaces, which portion extends from a fixed deflecting body to a deflecting body which is displaceable relative to the latter. Each such portion and the corresponding portions of the other winding strands lie in a cylindrical surface with horizontal generatrix so that all these portions together form a receiver of variable shape and size for the roll. The apparatus further comprises at least one pivotal holder for the displaceable deflecting bodies and a strand driving device for displacing the winding strands along their path by means of strand driving wheels, each of which acts without slippage on the beginning of a winding section.

An apparatus of this type and a process of the type defined above have been disclosed in Publication No. 0 031 286 of European patent application No. 80 401836. The roll of netting produced by the known process is made more compact and secured by means of several bracing wires which are delivered to the path of the netting and rolled up with the roll and act both on the innermost and on the outermost wire coil of the roll, and the roll is held together by several covering bands after it has been formed. In the known process, the netting is laid in zig-zag by being rolled up at a lower speed than that at which it is taken from the continuously operating braiding machine.

One disadvantage of the known process is that it requires the use of bracing wires which must be carried along with the netting and tightened after the netting has been rolled up, and another disadvantage is that the zig-zag formation of the netting is liable to be disturbed by irregular operation of the apparatus or of the braiding machine.

It is therefore a primary object of the present invention to provide a process of the type defined above which does not have these disadvantage and by which an at least equally compact roll of netting can be produced trouble-free with less expenditure of material and labour. This problem is solved according to the invention by carrying out the winding operation intermittently. The as yet unfinished roll is rolled over a stationary piece of zig-zag netting which is thereby rolled up and which is constantly being replaced at its rear end, and when this piece of netting has been replaced, the now enlarged roll together with the replacement piece is transported forwards, away from the position of zig-zag laying, by an amount approximately equal to the length of zig-zag laid netting, whereupon the next rolling movement is carried out. This process according to the invention of the type defined at the beginning has the advantage that bracing wires and the tensioning thereof can be dispensed with and that the wire in the roll of netting obtained is packed to a density which can hardly be improved upon. At the same time, the roll of netting produced by the process according to the invention can be stacked just as easily as one obtained by the known process. Moreover, in the process according to the invention, the zig-zag laying of the netting may be carried out independently of the operation of the braiding machine; it would normally be carried out in phase with the operation of this machine but in exceptional cases, when technical faults occur, it may also proceed out of phase with the delivery of netting from the machine.

It is a further object of the present invention to provide an apparatus of the type mentioned above which is especially suitable for carrying out the process according to the invention.

This problem is solved according to the invention by means of a winding driving device for shortening the winding portions of the strands during winding. For this purpose, the driving device comprises a winding driving wheel which acts without slippage on each winding strand outside its winding portion and is rotatable in the same sense of rotation and at a lower circumferential speed than that of the strand driving wheel acting on the same winding strand. The problem is further solved by a plurality of endless transport strands extending in parallel vertical planes along paths which cover each other at least in sections, each having a transport portion adjoining a guide surface, at least the initial sections of these portions being situated in the cylindrical surface mentioned above; and furthermore, by a transport driving device which transports the roll forwards by means of a transport driving wheel acting without slippage on each transport portion of strand while the length of the winding portions of the winding strands is being increased.

A preferred embodiment of the apparatus according to the invention, in which the strand driving device has a shaft like that of the known apparatus on which are mounted all the strand driving wheels forming the fixed deflecting bodies, is distinguished by the fact that the transport driving device has the same shaft on which all the transport driving wheels are mounted, and that the winding driving device has another shaft on which all the winding driving wheels are mounted. This mounting of the wheels and their distribution on only two shafts is the least complicated arrangement. The preferred embodiment, in which, as in the known apparatus, each displaceable deflecting body has its own holder, is further distinguished by the fact that each holder has a guide which supports the associated winding strand in its two extreme pivotal positions and holds it during the pivotal movement. This guide prevents uncontrolled displacement of the winding strands, thereby eliminating production stoppages to reposition the winding strands.

The preferred embodiment, in which the holders are mounted on a common rocking shaft as in the known apparatus, is further distinguished by the fact that the rocking shaft can be driven by a reversing drive. This reversing drive provides a simple and accurate means of controlling the synchronous rocking movements of all the holders.

The preferred embodiment, in which the winding strands, as in the known apparatus, each form a slack portion which is deflected by means of a deflecting roller acted upon by a force which keeps the slack portion taut, is further distinguished by the fact that the slack portion extends from its associated winding driving wheel to the associated strand driving wheel. Consequently, since the winding strands are guided along the holders, any activity of the winding driving device can only affect the winding portions and not the slack portions.

Lastly, the preferred embodiment is distinguished by freely rotatable grippers which may be operated and displaced pneumatically for gripping one end of a wire coil situated at the line of separation of the netting so that this wire can be unscrewed to separate one section of netting which is to form a roll from the next section which is to form the next roll as provided by a preferred embodiment of the press according to the invention.

The invention will now be described with reference to the drawings illustrating by way of example the preferred embodiment of the apparatus according to the invention.

FIG. 6 is a top plan view of a detail of the embodiment; and

FIG. 7 is a broken view of a roll of netting produced by an embodiment of the process according to the invention.

Figure 1:
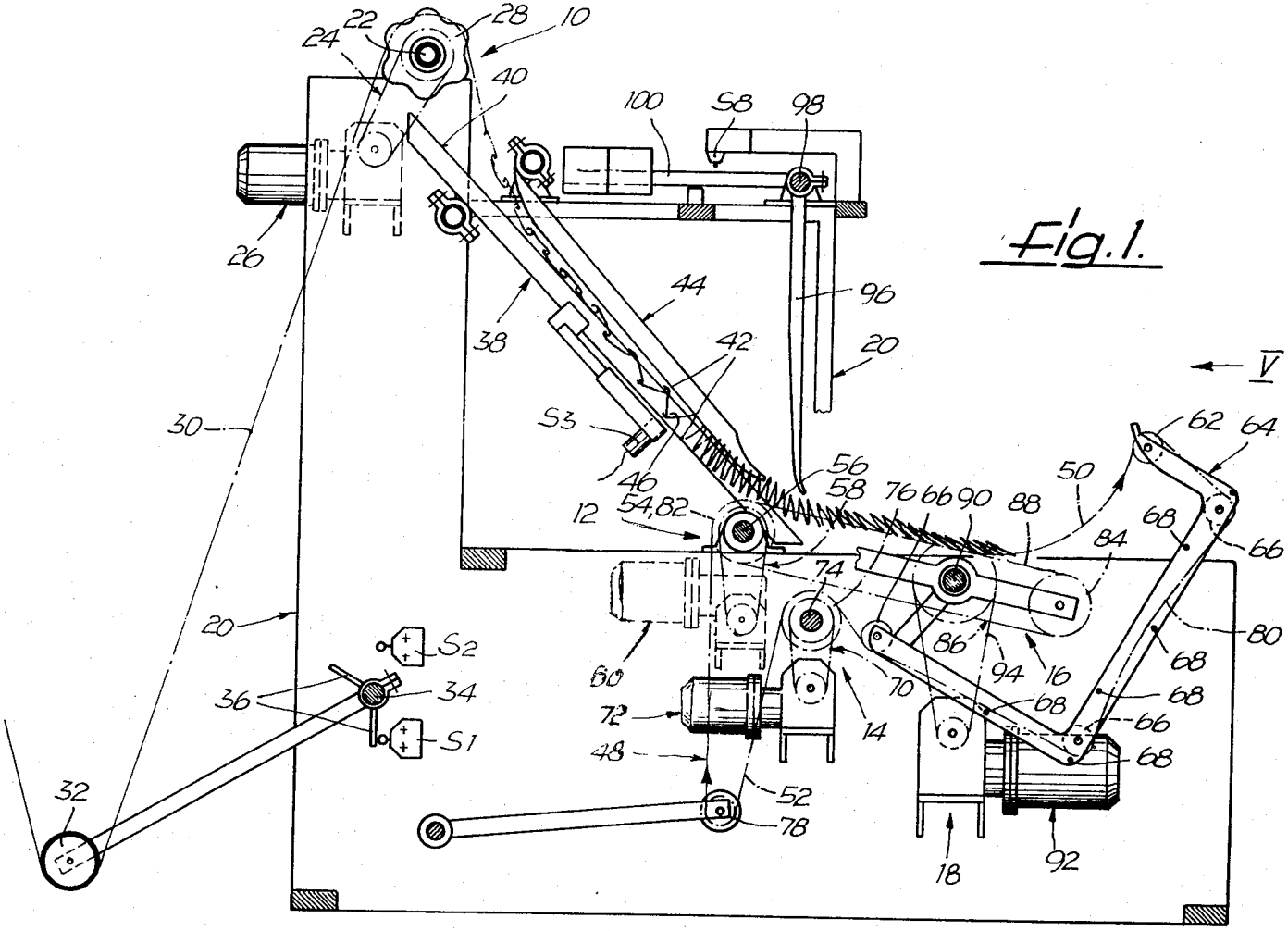
FIGS. 1 to 4 represent similar side views, which are partly schematic, of the embodiment at successive stages of the process.

The construction of the preferred embodiment is as follows: the main parts are a delivery driving device 10, a strand driving device 12, a winding driving device 14, a transport driving device 16 and a pivoting driving device 18. These five devices come into operation in part simultaneously and in part alternately, as will be clear from a description of the mode of operation of the whole apparatus.

The delivery driving device 10 is seated at the top end of a frame 20 of the apparatus and has a horizontal shaft 22 with a belt drive 24 by means of which it can be rotated clockwise as viewed in FIG. 1 by an electric geared motor 26. Seated on the shaft 22 is a plurality of axially displaceable delivery wheels 28 whose radial cams engage in meshes of the wire netting 30 which is to be delivered into the apparatus from a continuously operating braiding machine upstream of the apparatus. Situated between the braiding machine and the apparatus is a horizontal compensating roller 32, the netting 30 being deflected approximately over the lower half of this roller to be carried steeply upwards to the delivery wheels 28.

The axis of the compensating roller 32 is rigidly connected to a horizontal shaft 34 which is rotatably mounted in the frame 20 and which carries two radial pins 36 to actuate two electric switches S1 and S2. The motor 26 is started by the on-switch S1 and stopped by the off-switch S2.

The endless web of wire netting 30 deflected by the delivery wheels 28 travels almost vertically downwards to the adjustable guide rails 38 which carry on their upper sides parallel guide surfaces 40 all inclined at the same angle to the horizontal, on each of which is placed a row of linking and hooking points 42 of the netting 30. Situated above the inclined planes of the guide surfaces 40 are adjustable covering rails 44, one adjacent to each guide rail 38 and situated above another row of linking and hooking points 46 of the netting 30. Adjustably mounted on one of the guide rails 38 is a contact-free switch S3 which responds to a linking and hooking point 46 of the netting 30 laid in zig-zag formation at the lower end of the rails 38 and 44, when this point hangs far enough down below the adjacent guide surface 40.

Several endless winding strands 48, for example chains, extend in parallel vertical planes along paths which cover each other. Each of these strands 48 has a winding portion 50 adjoining the guide surfaces 40 and a slack portion 52 which is continuous with the winding portion 50 and hangs below the lower ends of the guide rails 38. The abovementioned connection (between 40 and 50) is obtained by the fact that the cylindrical surface in which the winding portions 50 lie as guide lines for a horizontal generatrix intersects the plane of the guide surfaces 40 at a very obtuse angle along a horizontal line above the slack portion 52. The winding portion 50 of each winding strand 48 supports a row of linking and hooking points of the wire netting 30, which row is situated at a distance from the row of supported linking and hooking points 42 equal to an integral multiple of the diagonal width of mesh b. All the winding portions 50 together constitute a receiver for a roll.

The strand driving device 12 for moving the winding strands 48 along their path comprises several strand driving wheels 54 which are mounted on a shaft 56 at the level of the lower end of the guide rails 38 and act each on a winding strand without slippage where its winding portion 50 begins. The strand driving wheels 54 also function as fixed deflecting bodies for the winding strands 48. The shaft 56 is rotated clockwise, as seen in FIG. 1, by an electric geared motor 60 acting on a driving belt 58.

The winding portion 50 of each winding strand 48 ends at a displaceable deflecting body, namely a sprocket wheel 62 which is situated at one end of a U-shaped holder 64 which also carries a sprocket wheel 66 at its other end and at its two corners. The holder 64 has pins 68 situated between the sprocket wheels 66, and together with the four sprocket wheels 62 and 66 they form a guide for the associated winding strand 48. All the holders 64 can be synchronously pivoted about a common horizontal axis from their extreme rocking position shown in FIG. 4 to the extreme rocking position shown in FIGS. 2 and 3 by way of the intermediate position shown in FIG. 1, and back.

The winding driving device 14 comprises a horizontal shaft 74 driven by an electric geared motor 72 by way of a belt drive 70. This shaft 74 carries several winding driving wheels 76 in the position where the slack portion 52 of the winding strand 48 begins. The slack portion ends at the corresponding strand driving wheel 54 and is permanently kept taut by a weight-loaded deflecting roller 78. Extending between the sprocket wheel 62 and the winding driving wheel 76 is a third portion 80 which together with the winding portion 50 and the slack portion 52 forms a closed winding strand.

The transport driving device 16 is identical to the strand driving device 12 in its shaft 56, belt drive 58 and electric motor 60. In addition, it has a plurality of transport driving wheels 82 mounted on the shaft 56. These driving wheels 82 are sprocket wheels like the strand driving wheels and the winding driving wheels 54 and 76. Together with another sprocket wheel 84 of fixed location, these transport driving wheels 82 serve to keep a transport strand 86 taut along its oval path. The upper transport portion 88 of this strand, which is inclined to the horizontal, departs from its associated transport driving wheel 82 in a direction parallel to the beginning of the adjacent winding portion 50. The strand driving wheels 54 and the transport driving wheels 82 have the same diameter so that the transport portions 88 also begin at the above mentioned line of intersection of the inclined plane containing the guide surfaces 40 with the cylindrical surfaces containing the winding portions 50.

The pivot driving device 18 has a horizontal shaft 90 parallel to the shaft 22, the shaft 34, the shaft 56 and the shaft 74. This shaft 90 is rotatable backwards and forwards by a reversing drive consisting of an electric geared motor 92 and a belt drive 94 connecting the motor with the shaft. The holders 64 are non-rotatably connected to the shaft 90 near their sprocket wheels 66 so that rotation of the shaft is accompanied by a pivoting movement of the holders about the axis of this shaft. At each end of the shaft 90 there are mounted two cams to operate two switches S4 and S5 and, respectively, S6 and S7. These switches form part of a sequence control whose function will be clear from the description of the mode of operation of the apparatus.

In the middle of the apparatus, two parallel switching arms 96 are suspended on a horizontal shaft 98 so that their lower ends, which curve away from the guide rails 38, are situated above the lower ends of these rails. The shaft 98 carries a weight-loaded radial lever 100 to operate a switch S8 by pressure when the switching arms 96 are rocked clockwise (in the view of FIG. 1) about the axis of the shaft 98 from their normal vertical position.

The mode of operation of the described preferred embodiment of the apparatus according to the invention is as follows: Starting from the stage shown in FIG. 4, in which only motor 26 is running while motors 60, 72 and 92 are at a standstill, the holders 64 are in their lowermost rocking position, in which the sprocket wheels 66 are moved away from the portions 80 of the winding strands 48 while the winding portions 50 lie parallel to the transport portions 88 in the inclined plane of the latter, so that a completed roll of wire netting can be rolled away.

Figure 4:
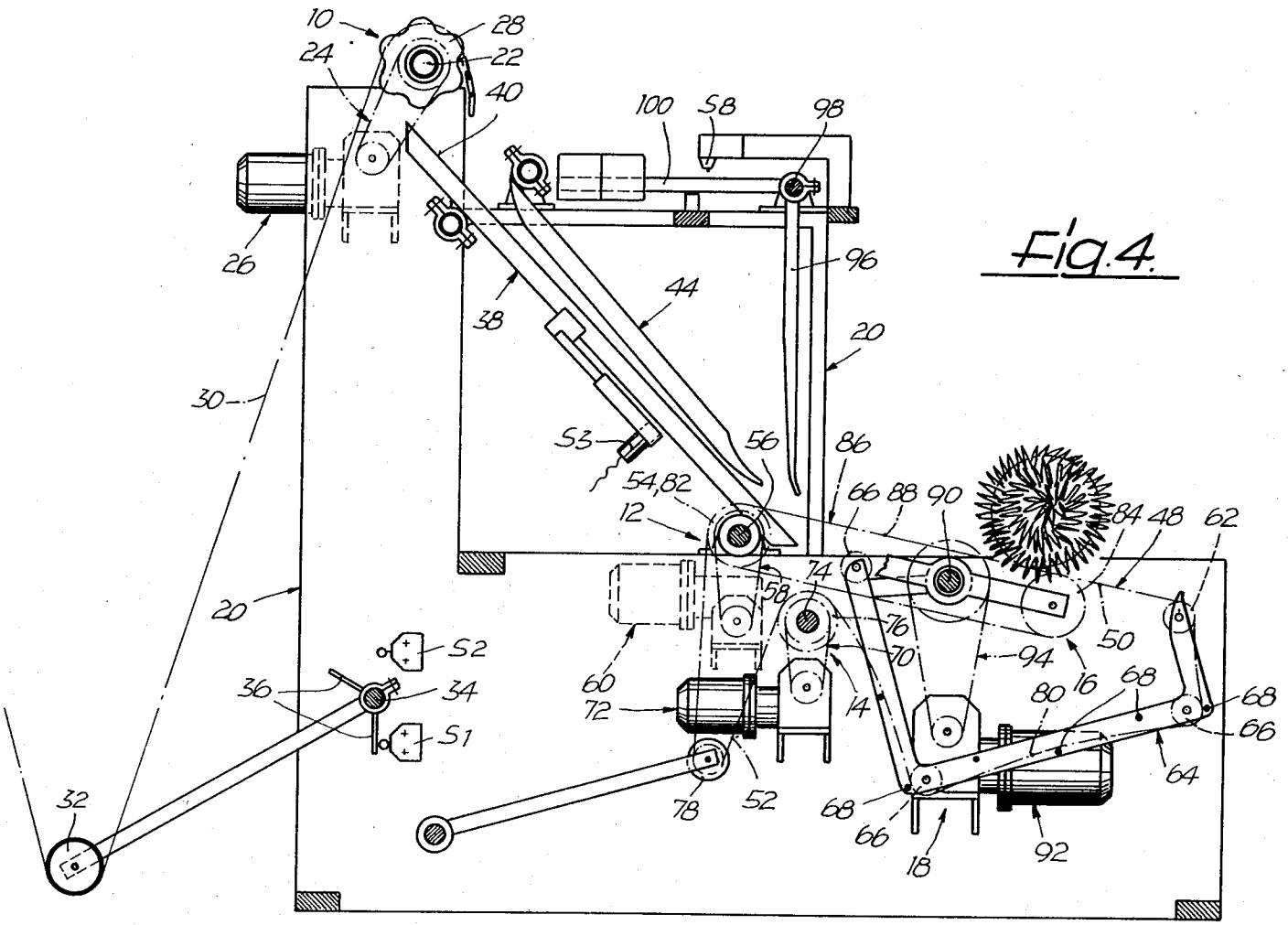
Figure 5:
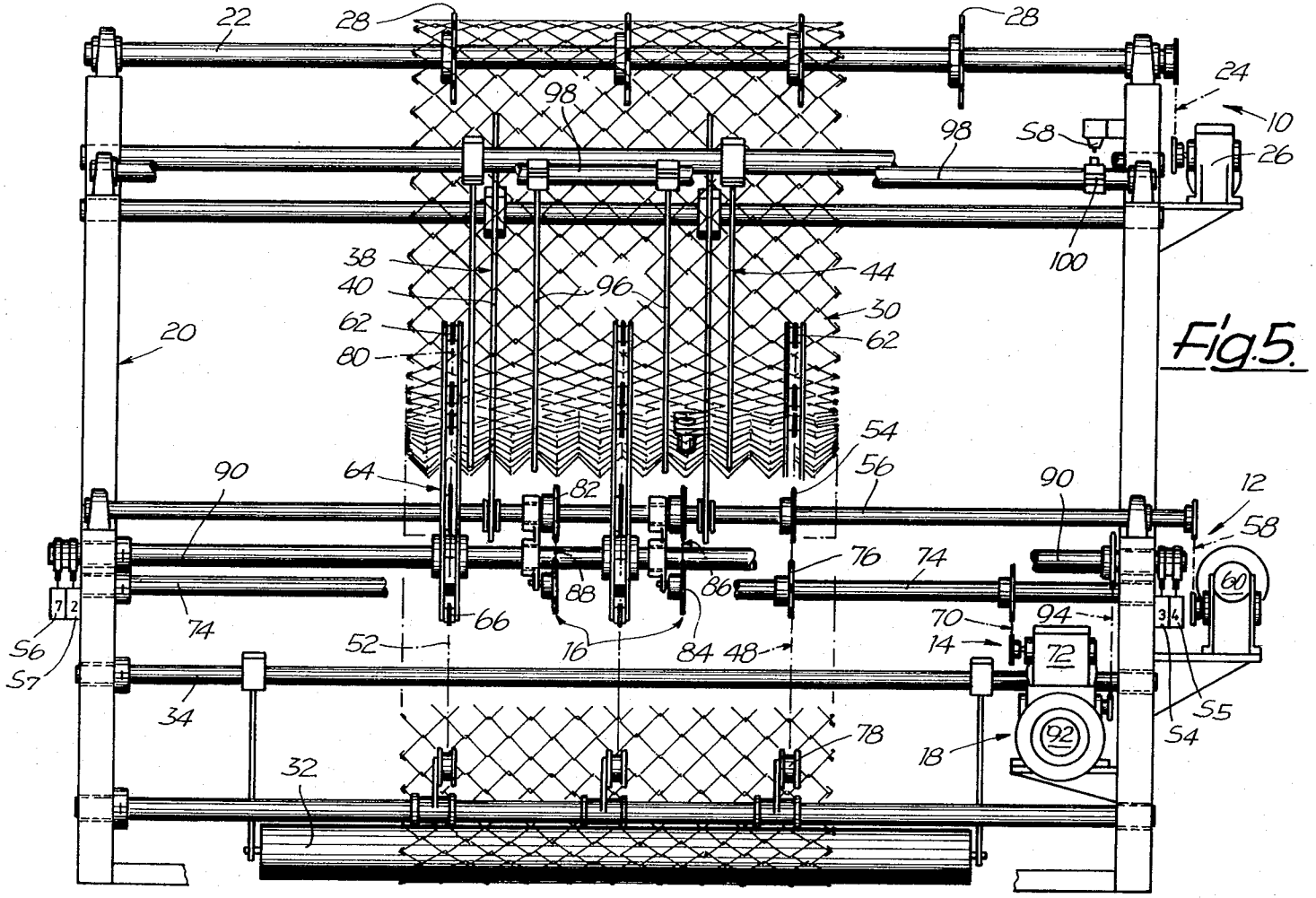
FIG. 5 is a front view of the embodiment seen in the direction of the arrow V in FIG. 1.

Due to the continous delivery of wire netting 30 arriving at the compensating roller 32, the front edge of the section of netting which is to form the next roll, which in FIG. 4 hangs over the delivery wheels 28, eventually reaches the guide rails 38 and slides down over them until it reaches the beginning of the winding portions 50 and transport portions 88, whereupon the netting begins to be laid in zig-zag formation under the influence of gravity and with the aid of the guide rails 38, and the switch S3 is actuated by a linking and hooking point 46. Up to that moment, the holders 64 have been displaced from their middle pivoting position shown in FIG. 1, in which the sprocket wheels 66 engage the portions 80 of the winding strands 48 near the winding drive wheels 76 while the sprocket wheels 62 are situated at a higher level than the strand driving wheels 54 so that the portions 50 of the winding strands extend along a natural chain line above the sprocket wheels 84.

When the switch S3 responds, the motors 60 and 72 simultaneously start to rotate in the same sense, which means that, as viewed in FIG. 1, the shaft 56 is rotated clockwise while the shaft 74 is rotated anticlockwise so that each winding strand 48 taken as a whole can rotate clockwise. Consequently, the transport portions 88, unobstructed by the winding portions 50 moving with them, continue to shift the zig-zag netting 30 which has formed up to now away from the switch S3 until a clock element simultaneously switches off both motors 60 and 72. The clock element may be adjusted to an empirically determined value so that this transport movement continues only so long as zig-zag netting is available for transport. After one or more repetitions of this transport operation, the front edge of the portion of netting intended for the new roll reaches the position indicated in FIG. 1, at which the winding portions 50 begin to rise above the transport portions 88. The clock element is now stopped from acting on the motor 72 for the duration of formation of the new roll, either manually or by means of a feeler arranged in the position mentioned above to detect the arrival of the front edge of this new section of netting. The motor 92 is now switched on so that the holders 64 are moved from their middle pivoting position into their uppermost position shown in FIGS. 2 and 3, in which the sprocket wheels 62, viewed in the direction of arrow V, are situated behind the free lower ends of the two switching arms 96. As a result, the front edge of the netting is thrown over backwards so that it forms the innermost layer of the roll which now develops stepwise. At the command of the switch S3, which responds whenever a sufficiently long piece of zig-zag netting has formed from the netting 30 delivered into the apparatus, the motors 60 and 72 are again started so that the beginning of the roll and the adjoining length of netting which has meanwhile been laid in zig-zag can be transported forwards until the clock element switches off the motor 60. Continued rotation of the motor 72 then shortens the winding portions 50 since their beginning portions are held fast by the strand driving wheels 54 which are now at a standstill. As the winding portions 50 become shorter, they carry the circumference of the forming roll with them so that the as yet unfinished roll is rotated about its axis and at the same time subjected to a movement of translation transversely to its axis so that it is rolled over the adjoining piece of zig-zag netting which lies in a plane on the transport portions 88. At the end of this winding process, the roll moves the switching arms 96 so that they actuate the switch S8 to bring the motor 72 to a standstill.

Figure 2:
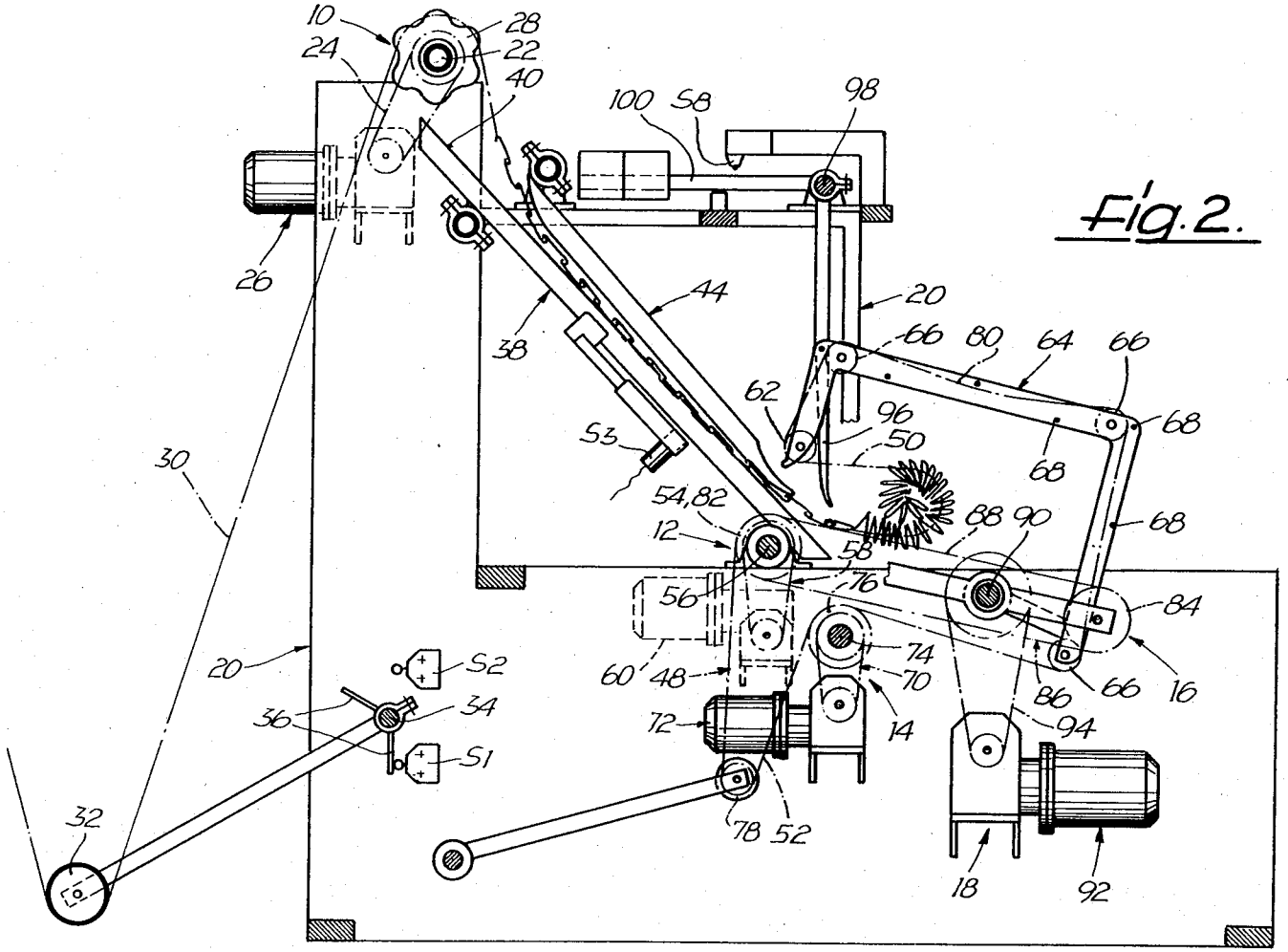
Figure 3:
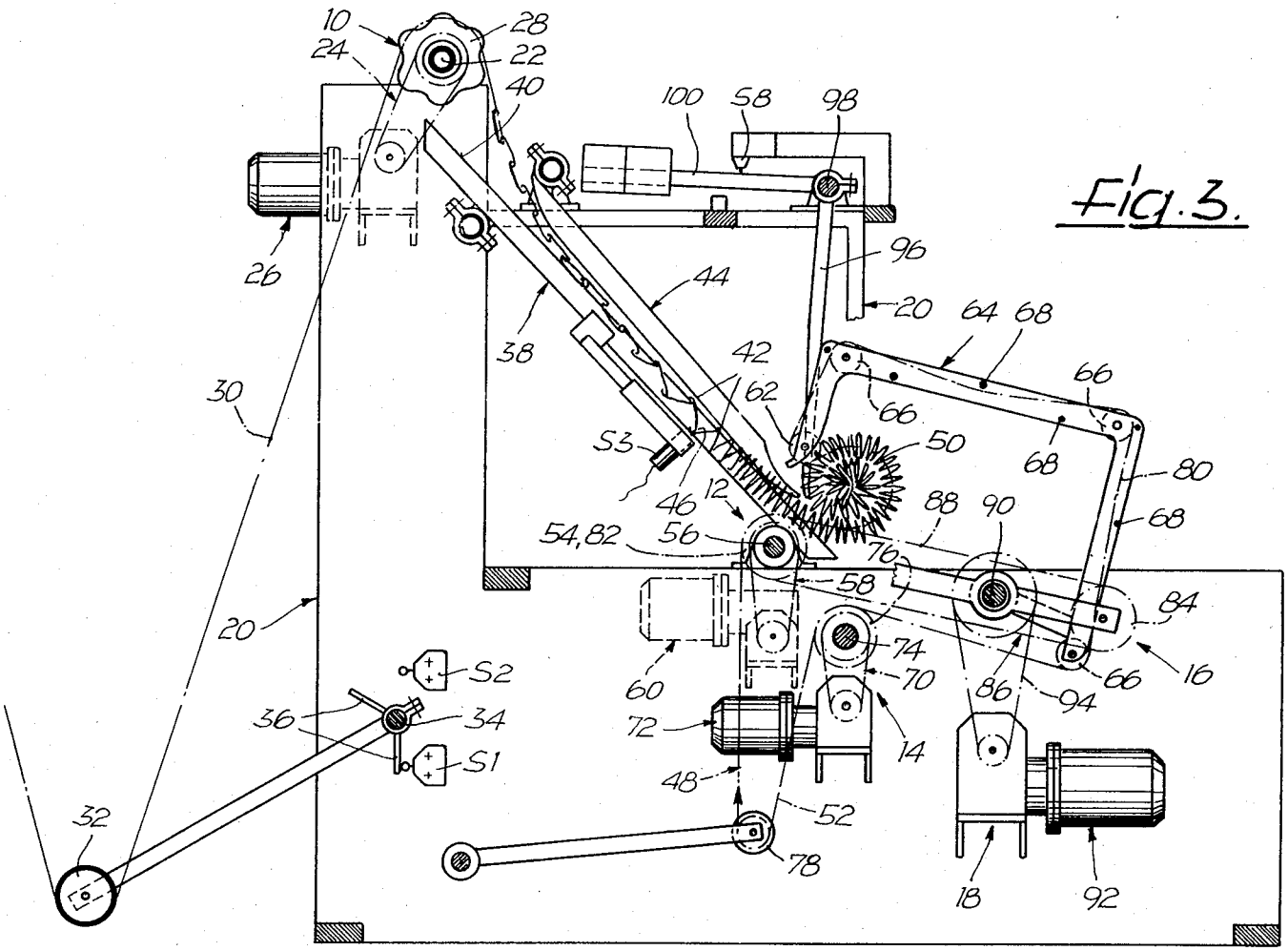

When the apparatus has progressed from the stage shown in FIG. 2 to the stage shown in FIG. 3 and the switch S3 has again switched on the two motors 60 and 72, the unfinished roll lying near the sprocket wheels 62 and the adjoining piece of zig-zag netting are moved forwards by the transport portions 88, and the winding portions 50 which have been shortened now gradually lengthen, and by the time the motor 60 comes to a standstill they have resumed their original length, and they are then again shortened due to continued running of the motor 72. Lengthening of the winding portions 50 is achieved by rotating the driving wheels 54 and 82 at a higher circumferential speed than the winding driving wheels 76 so long as both motors 60 and 72 are switched on.

When rolling of the unfinished roll over the zig-zag netting and forward transport of the now enlarged roll together with freshly folded zig-zag netting have taken place alternately several times in succession, the netting 30 is severed by removal of a coil of wire at the top end of the guide rails 38, either by hand or by means of remote controlled grippers (not shown). The apparatus then continues to run until the rear end of the section of netting which is to be rolled up forms the outermost layer of the roll, which means that the roll is completed. Instead of moving the holders 64 from their uppermost pivotal position shown in FIGS. 2 and 3 into their lowermost position of FIG. 4 through the intermediate position of FIG. 1 by means of the motor 92, the pivotal movement may be stopped when the position shown in FIG. 1 has been reached if the apparatus is equipped with roll grippers which can lift the roll of wire netting from the winding portions 50 and deposit it outside the apparatus. The completed roll of netting is wrapped in at least two wrapping bands as shown in FIG. 7 before it is delivered from the apparatus.

We claim:

1. Apparatus for automatic production of reelless rolls of an endless web of wire netting formed of flat pressed wire rolls wound into each other comprising several parallel guide surfaces equally inclined to the horizontal, each of which is provided for a row of linking and hooking points of the netting; further comprising several endless winding strands extending in parallel vertical planes along paths which cover each other at least in corresponding sections when projected on each other in a horizontal direction perpendicular to the said vertical planes, each of which strands has a winding portion, a fixed deflecting body, and a displaceable deflecting body, said winding portion adjoining the guide surfaces and extending from said fixed deflecting body to said displaceable deflecting body which is displaceable relative to the fixed deflecting body, said winding portion and corresponding winding portions of the other winding strands which lie in a cylindrical surface with horizontal generatrix, together forming a receiver of variable form and size for the roll; also comprising at least one rocking holder for the displaceable deflecting bodies; and comprising a strand driving device for displacing the winding strands along their paths, the strand driving device acting without slippage on each winding portion by means of a strand driving wheel; characterized by a winding driving device for shortening the winding portions during the winding operation by means of a winding driving wheel acting without slippage on each winding strand outside its winding portion, which winding driving wheel is rotatable in the same sense and at a lower circumferential speed than the strand driving wheel which acts on the same winding strand; further characterized by a plurality of endless transport strands which extend in parallel vertical planes along paths which cover each other at least in sections, each of said strands having a transport portion with a beginning section adjoining one of said guide surface, at least the beginning sections of the transport portions lying in the aforesaid cylindrical surface; and by a transport driving device for transport of the roll during a lengthening of the winding portions, said transport being effected by a transport driving wheel acting without slippage on each transport portion.

2. Apparatus according to claim 1, the strand driving device of which has a shaft on which all the strand driving wheels forming the fixed deflecting body are mounted, characterized in that the transport driving device has the same shaft on which all the transport driving wheels are mounted and in that the winding driving device has another shaft on which all the winding driving wheels are mounted.

3. Apparatus according to claim 2, in which each winding strand forms a slack portion which is deflected over a deflecting roller which is subjected to a force holding the slack portion taut, characterized in that the slack portion extends from the associated winding driving wheel to the associated strand driving wheel.

4. Apparatus according to claim 1, in which each displaceable deflecting body has its own holder associated with it, characterized in that on each holder is provided a guide means for holding the associated winding strand in a first of two extreme rocking positions (FIGS. 3, 4) of said holder in which first position the holder is nearest to said guide surfaces, and in a second of said two extreme rocking positions of said holder in which second position the holder is farthest to said guide surfaces, and for supporting said associated winding strand during the rocking movement of said holder between its said two extreme rocking positions.

5. Apparatus according to claim 4, in which the holders are mounted on a common rocking shaft, characterized in that the rocking shaft is rotatable by means of a reversing drive.

6. In a method for automatically producing reelless rolls of a web of wire netting comprising the steps of:

(a) laying a first segment of the endless wire netting into a zig-zag formation;

(b) shifting only said first segment of the zig-zag wire netting onto a forming section of a machine; said shifting being carried out by a transport portion of an endless transport strand;

(c) forming an innermost layer of said reelless roll from said first segment of zig-zag wire netting by raising a winding portion of an endless winding strand above the transport portion, said first segment of netting being stationary during the forming steps;

(d) laying a second segment of the endless wire netting into a zig-zag formation during shifting said first segment;

(e) shifting said second segment of zig-zag wire netting onto said forming section, the innermost layer of said reelless roll which adjoins said second segment also being shifted;

(f) forming a second layer of said reelless roll by rolling the innermost layer of said roll over said second segment of zig-zag wire netting, said second segment being stationary during the rolling, the forming being carried out by shortening the winding portion of the winding strand; and (g) repeating said steps of laying, shifting, and forming with additional segments of endless wire netting until said roll has reached a desired size.

7. The method according to claim 6 wherein said forming steps are carried out intermittently.

8. The method according to claim 7 wherein said steps of forming said roll involve only one of said first, second, and additional segments of endless netting at a given time.

9. The method according to claim 6 wherein said step of shifting said first segment of said zig-zag netting continues until said netting reaches a pre-determined point in the forming section of said machine.

10. The method according to claim 6 wherein said steps of laying are carried out with continuously fed wire netting.

11. The method according to claim 6 wherein the first, second, and additional segments of wire netting used to form said roll are separated from said endless web by removing a coil of said netting where said segments adjoin said web.

* * * * *